US005340102A

United States Patent [19]

Adamson et al.

[11] Patent Number: 5,340,102

[45] Date of Patent: Aug. 23, 1994

[54] RACKET ATTACHMENT WHISTLE

[76] Inventors: Kenneth P. Adamson, P.O. Box 334, Tortola, British Virgin Islands, British Virgin Isls.; George Spector, 233 Broadway Rm. 702, New York, N.Y. 10279

[21] Appl. No.: 47,956

[22] Filed: Apr. 19, 1993

[51] Int. Cl.[5] ..... A63B 69/38

[52] U.S. Cl. ..... 273/29 A

[58] Field of Search ..... 273/35 R, 29 A, 186 D, 273/162 R, 186 A, 183 R, 183 D, 186 R, 73 K, 26 R, 26 B

[56] References Cited

U.S. PATENT DOCUMENTS

| | | | |
|---|---|---|---|
| 2,780,098 | 2/1957 | Marah | 273/29 A |
| 2,950,115 | 8/1960 | Hurdzan | 273/186.1 |
| 3,113,781 | 12/1963 | Guier | 273/26 B |
| 3,113,782 | 12/1963 | Guier | 273/26 B |
| 3,137,504 | 6/1964 | Zordan et al. | 273/26 B |
| 4,090,707 | 5/1978 | Saar | 273/29 A |
| 4,094,504 | 6/1978 | Barasch | 273/29 A |
| 4,101,132 | 7/1978 | Conrey | 273/29 A |
| 4,274,631 | 6/1981 | Hayazaki | 273/26 B |
| 4,898,386 | 2/1990 | Anderson | 273/26 B |
| 5,133,551 | 7/1992 | Handy | 273/26 B |

*Primary Examiner*—Theatrice Brown

[57] ABSTRACT

A training device for a tennis racket is provided which consists of a clamp for attaching a small whistle transversely to a throat of the tennis racket. A first sound will be made by the small whistle, when a tennis player swings the tennis racket in a slice position. A second sound will be made by the small whistle when the tennis player swings the tennis racket in a top spin position.

3 Claims, 1 Drawing Sheet

RACKET ATTACHMENT WHISTLE

BACKGROUND OF THE INVENTION

The instant invention relates generally to tennis equipment and more specifically it relates to a training device for a tennis racket, which provides two different oriented and pitched whistles to improve the swing of a tennis player.

There are available various conventional tennis equipment which do not provide the novel improvements of the invention herein disclosed.

SUMMARY OF THE INVENTION

A primary object of the present invention is to provide a training device for a tennis racket that will overcome the shortcomings of the prior art devices.

Another object is to provide a training device for a tennis racket which presents a differently oriented and pitched whistle, which sounds when the tennis racket is in a slice position and in a top spin position, so as to improve the swing of a tennis player.

An additional object is to provide a training device for a tennis racket that can be attached quickly to the throat of the tennis racket and is light in weight, so as not to interfere with the swing of the tennis player.

A further object is to provide a training device for a tennis racket that is simple and easy to use.

A still further object is to provide a training device for a tennis racket that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
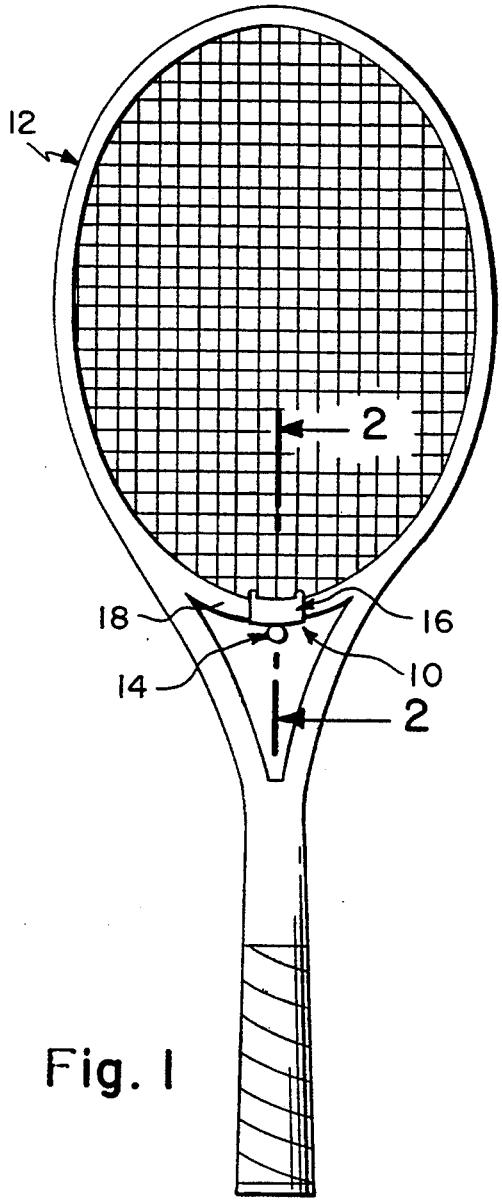
FIG. 1 is an elevational view of a racket with the instant invention installed on the throat.
Figure 2:
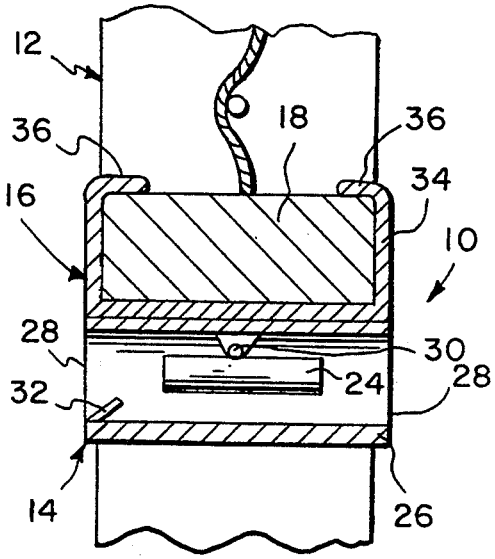
FIG. 2 is an enlarged cross sectional view taken along line 2—2 in FIG. 1, showing the internal structure of the instant invention.
Figure 3:
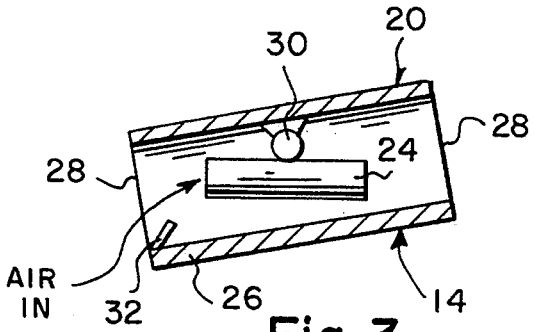
FIG. 3 is a diagrammatic cross sectional view showing the slice position.
Figure 4:
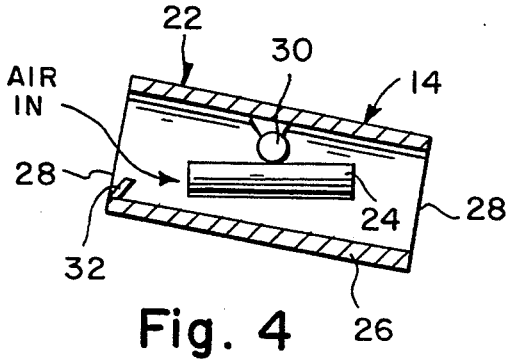
FIG. 4 is a diagrammatic cross sectional view showing the top spin position producing a different sound.

Turning now descriptively to the drawings, in which similar reference characters denote similar elements throughout the several views, the Figures illustrate a training device 10 for a tennis racket 12, which consists of an apparatus 14 for producing two different oriented and pitched whistles and a structure 16 for attaching the whistle apparatus 14 transversely to a throat 18 of the tennis racket 12. A first sound will be made by the whistle apparatus 14, when a tennis player swings the tennis racket 12 in a slice position 20. A second sound will be made by the whistle apparatus 14, when the tennis player swings the tennis racket 12 in a top spin position 22.

The whistle apparatus 14 includes a vibration member 24 and a cylindrical housing 26 having opened ends 28. A ball pivot bracket 30 connects the vibration member 24 within the cylindrical housing 26, so that the vibration member 24 will always maintain a horizontal orientation with respect to the cylindrical housing 26. A deflector 32 is located at the forward open end 28 of the cylindrical housing 26, so as to change the air flow into the vibration member 24, to produce the two different oriented and pitched whistles.

The attaching structure 16 is a clamp 34 having a plurality of fingers 36, which can bend about the throat 18 of the tennis racket. The vibration member 24, the cylindrical housing 26, the ball pivot bracket 30, the deflector 32 and the clamp 34, are all fabricated out of a durable material, such as metal, plastic and similar materials.

To use the training device 10, a tennis player simply attaches the fingers 36 of the clamp 34 about the throat 18 of the tennis racket 12. The tennis racket 12 is now ready to be swung by the tennis player, to improve the slice position and the top spin position of the tennis racket 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A training device in combination with a tennis racket having a throat wherein said device comprises:

a) whistle means for producing two different pitched whistle sounds;

b) means for attaching said whistle means transversely to said throat of the tennis racket, so that a first whistle sound will be made by said whistle means when a tennis player swings the tennis racket in a slice position and a second sound will be made by said whistle means when a tennis player swings the tennis racket in a top spin position; wherein said whistle means includes:

c) a vibration member;

d) a cylindrical hollow housing having forward and rearward open ends;

e) a ball pivot bracket pivotally connection said vibration member within said cylindrical housing, so that said vibration member will always maintained a substantially horizontal orientation with respect to said cylindrical housing; and f) a deflector located to said forward open end of said cylindrical housing, so as to deflect the air flow into said vibration member at different angles to produce the two different pitched whistle sounds, in accordance with the racket orientation in a slice or top spin position.

2. A training device as recited in claim 1, wherein said attaching means is a clamp having a plurality of fingers which can bend about said throat of the tennis racket.

3. A training device as recited in claim 2, wherein said vibration member, said cylindrical housing, said ball pivot bracket, said deflector and said clamp are all fabricated out of a durable material.

* * * * *